US011767571B2

(12) United States Patent
Omura et al.

(10) Patent No.: US 11,767,571 B2
(45) Date of Patent: Sep. 26, 2023

(54) METHOD OF PRODUCING GRAIN-ORIENTED ELECTRICAL STEEL SHEET AND PRODUCTION LINE THEREFOR

(71) Applicant: JFE STEEL CORPORATION, Tokyo (JP)

(72) Inventors: Takeshi Omura, Tokyo (JP); Hirotaka Inoue, Tokyo (JP); Shigehiro Takajo, Tokyo (JP); Seiji Okabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 153 days.

(21) Appl. No.: 16/081,121

(22) PCT Filed: Mar. 8, 2017

(86) PCT No.: PCT/JP2017/009313

§ 371 (c)(1),
(2) Date: Aug. 30, 2018

(87) PCT Pub. No.: WO2017/159507

PCT Pub. Date: Sep. 21, 2017

(65) Prior Publication Data

US 2019/0017139 A1 Jan. 17, 2019

(30) Foreign Application Priority Data

Mar. 15, 2016 (JP) ..... 2016-051466

(51) Int. Cl.
*C21D 8/12* (2006.01)
*H01F 1/147* (2006.01)
(Continued)

(52) U.S. Cl.
CPC ..... *C21D 8/1277* (2013.01); *C21D 8/12* (2013.01); *C21D 8/1222* (2013.01);
(Continued)

(58) Field of Classification Search
CPC ..... C21D 8/1277
See application file for complete search history.

(56) References Cited

U.S. PATENT DOCUMENTS 9,330,839 B2 5/2016 Omura et al.
2014/0234638 A1* 8/2014 Takajo ..... C21D 8/12 428/450

(Continued)

FOREIGN PATENT DOCUMENTS

EP 2762578 A1 8/2014
JP H03287725 A 12/1991

(Continued)

OTHER PUBLICATIONS

Aug. 21, 2018, Notification of Reasons for Refusal issued by the Japan Patent Office in the corresponding Japanese Patent Application No. 2016-051466 with English language Concise Statement of Relevance.

(Continued)

*Primary Examiner* — Jenny R Wu
(74) *Attorney, Agent, or Firm* — KENJA IP LAW PC

(57) ABSTRACT

To reduce variations in iron loss among materials subjected to magnetic domain refining by electron beam irradiation and to stably obtain good iron loss properties, disclosed is a method of producing a grain-oriented electrical steel sheet including performing magnetic domain refining treatment by irradiating with an electron beam, in a pressure reduced area, a surface of a grain-oriented electrical steel sheet after subjection to final annealing, the method further including: before the irradiating with the electron beam, delivering the grain-oriented electrical steel sheet wound in a coil shape and heating the delivered grain-oriented electrical steel sheet to 50° C. or higher; and then cooling the grain-oriented electrical steel sheet such that the grain-oriented electrical steel sheet has a temperature of lower than 50° C. at the time of entering the pressure reduced area.

6 Claims, 5 Drawing Sheets

(51) Int. Cl.

| | |
|---|---|
| *C22C 38/60* | (2006.01) |
| *C22C 38/00* | (2006.01) |
| *C22C 38/02* | (2006.01) |
| *C22C 38/04* | (2006.01) |
| *C22C 38/06* | (2006.01) |
| *C22C 38/08* | (2006.01) |
| *C22C 38/34* | (2006.01) |

(52) U.S. Cl.
CPC ..... *C21D 8/1233* (2013.01); *H01F 1/147* (2013.01); *C21D 2201/05* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/34* (2013.01); *C22C 38/60* (2013.01)

(56) References Cited

U.S. PATENT DOCUMENTS

| | | | | |
|---|---|---|---|---|
| 2014/0272399 | A1* | 9/2014 | Bohm | H01F 1/18 427/104 |
| 2015/0267273 | A1* | 9/2015 | Takajo | H01F 1/16 148/112 |

FOREIGN PATENT DOCUMENTS

| | | | |
|---|---|---|---|
| JP | H06109900 | A | 4/1994 |
| JP | 2012052230 | A | 3/2012 |
| JP | 2012177149 | A | 9/2012 |
| JP | 2014019901 | A | 2/2014 |
| KR | 1385742 | B1 * | 4/2014 |

OTHER PUBLICATIONS

Jan. 9, 2020, Office Action issued by the Korean Intellectual Property Office in the corresponding Korean Patent Application No. 10-2018-7025940 with English language concise statement of relevance.

Jun. 13, 2017, International Search Report issued in the International Patent Application No. PCT/JP2017/009313.

May 8, 2019, Office Action issued by the China National Intellectual Property Administration in the corresponding Chinese Patent Application No. 201780016042.6 with English language search report.

Nov. 14, 2018, the Extended European Search Report issued by the European Patent Office in the corresponding European Patent Application No. 17766508.0.

* cited by examiner

METHOD OF PRODUCING GRAIN-ORIENTED ELECTRICAL STEEL SHEET AND PRODUCTION LINE THEREFOR

TECHNICAL FIELD

The present disclosure relates to a method of producing a grain-oriented electrical steel sheet suitable for an iron core material of transformers and the like, and a production line directly used for the method.

BACKGROUND

Grain-oriented electrical steel sheets, which are mainly used as iron cores of transformers, are required to have excellent magnetic properties, in particular, low iron loss properties. In this respect, it is important to highly accord secondary recrystallized grains of a steel sheet with (110) [001] orientation, i.e. the "Goss orientation", and reduce impurities in a product steel sheet. Moreover, a technique for introducing thermal strain using an electron beam to the surface of the steel sheet and subdividing the magnetic domain width to reduce iron loss is described in, for example, JP201252230A (PTL 1) and JP2012177149A (PTL 2).

CITATION LIST

Patent Literature

PTL 1: JP201252230A
PTL 2: JP2012177149A

SUMMARY

Technical Problem

Applying these techniques realizes a significant reduction in iron loss, but comparing the iron losses of the steel strips at the same magnetic flux density level, there is a large variation among the steel strips, and there remains an issue of how to address such variations in iron loss properties.

It would thus be helpful to provide a method of stably obtaining good iron loss properties by reducing variations in iron loss among magnetic domain refining materials by electron beam irradiation.

Solution to Problem

First, the following describes the experiments conducted to specify the cause of variations in iron loss and the improvement measure in grain-oriented electrical steel sheets with magnetic domains subdivided by electron beam irradiation.

Experiment 1

On a 0.30 mm thick grain-oriented electrical steel strip (hereinafter also referred to as a steel strip), electron beam irradiation was performed under a set of conditions including: an accelerating voltage of 120 kV; a current of 20 mA; a scanning rate of 150 m/s; an irradiation point interval of 0.32 mm; and an interval in the rolling direction of 5 mm. For the electron beam irradiation, a steel strip taken out from the coil after subjection to the final annealing was introduced into a vacuum vessel, and the electron beam irradiation was performed in the vacuum vessel. At this time, the sheet passage speed of the steel strip was changed within the range of 20 m/min to 200 m/min, and the relationship between the pressure in the vacuum vessel (hereinafter referred to as vacuum degree) and the sheet passage speed on iron loss was investigated. Since the iron loss value varies depending on the magnetic flux density level, samples at the same magnetic flux density level ($B_8$=1.93 T) were evaluated.

FIG. 1 illustrates the relationship between the sheet passage speed and the vacuum degree. In this experiment, different steel strips were passed at the same sheet passage speed, and the variation in vacuum degree at that time was also evaluated. In FIG. 1, error bars in the vacuum degree plots indicate standard deviations.

As illustrated in FIG. 1, when the sheet passage speed is 100 m/min or less, the vacuum degree does not change greatly. However, there was a trend that when the sheet passage speed exceeded 100 m/min, the vacuum degree (pressure) increased and the vacuum property decreased. The reason is considered to be that the amount of moisture to be brought in from the steel strip is large and the existing vacuum pump cannot ensure adequate evacuation to the demand as the sheet passage speed increases. In addition, there are variations in the vacuum degree even at the same sheet passage speed. The reason is considered to be that the amount of moisture adhered to the steel strip differs among the steel strips. Reasons for the fluctuation of the adhered moisture content include the retention period of the steel strip until the electron beam irradiation after the final annealing, the retention time (whether in high humidity or low humidity season), and so on. There was a tendency that the variation in the vacuum degree increases with increasing sheet passage speed.

Next, FIG. 2 illustrates the relationship between the iron loss and the sheet passage speed. In FIG. 2, error bars in the iron loss plots indicate standard deviations.

As illustrated in FIG. 2, the iron loss was not greatly changed at a sheet passage speed of 100 m/min or less, but the iron loss tended to increase when the sheet passage speed was over 100 m/min. There was another tendency that variations in iron loss become more pronounced as the sheet passage speed increases. It was also found that even at the same sheet passage speed, there was a variation of ±0.02 W/kg or more in iron loss. The relationship between the iron loss and the sheet passage speed was in agreement with the relationship between the vacuum degree and the sheet passage speed.

Therefore, in order to stabilize iron loss properties at a high level, control of the vacuum degree was considered to be important, and we investigated how to stabilize the vacuum degree. First, increase in impurity concentration in the electron beam irradiation atmosphere is one of the causes of the deterioration of iron loss properties and the increase of the variation when the vacuum degree value indicated by pressure increases (pressure rise) and the vacuum property is degraded. That is, when the impurity concentration is increased, chances are increased that the irradiated electron beam interferes with impurities, and the amount of the electron beam reaching the steel sheet becomes unstable. Therefore, in order to stabilize the vacuum degree, it is effective to make the sheet passage speed constant, but in order to stably ensure continuous sheet passage, control of the sheet passage speed is inevitable, the change in the vacuum degree due to the fluctuation in the sheet passage speed becomes a factor that cannot be ignored to suppress variations in iron loss. In other words, it is effective to suppress the fluctuation of the vacuum degree in order to suppress variations in iron loss.

Experiment 2

In order to stabilize the vacuum degree, it is effective to increase the evacuation capacity of the vacuum pump. However, increasing the evacuation capacity of the vacuum pump requires a significant cost increase. As mentioned above, the variation in the vacuum degree can be caused by the change of the moisture carried in the steel sheet, and we studied measures to reduce this amount of moisture carried in. Specifically, after the steel strip wound in a coil shape was taken out, the steel sheet was heated to 40° C. to 200° C. until it reached the reduced pressure area (vacuum vessel) for electron beam irradiation. FIGS. 3A and 3B illustrate the relationship between the heating temperature and the vacuum degree at different sheet passing speeds. Experimental conditions other than steel sheet heating are the same as those in Experiment 1. It can be seen from FIG. 3 that the absolute value and the variation of the vacuum degree are greatly reduced by setting the heating temperature of the steel sheet to 50° C. or higher regardless of the sheet passage speed.

Experiment 3

We then evaluated the influence of the steel sheet heating on the reduction of the variation in the vacuum degree. In this case, after delivering the steel strip wound in a coil shape, the steel sheet was heated to 200° C. before it reached the reduced pressure area (vacuum vessel) for electron beam irradiation, and the sheet passage speed was changed within the range of 20 m/min to 150 m/min. Experimental conditions are otherwise the same as those in Experiment 1. FIG. 4 illustrates the relationship between the vacuum degree and the sheet passage speed. A good vacuum degree was maintained at any of the sheet passage speeds, and the variation in the vacuum degree in the same speed range was reduced as compared with the one in which the steel sheet was not subjected to heating (FIG. 1).

Further, the investigation result on the relationship between the iron loss properties and the sheet passage speed is illustrated in FIG. 5. Regarding the vacuum degree, despite the fact that the absolute value and the variation were both good in any of the sheet passage speed ranges, the absolute value of iron loss tended to deteriorate when the sheet passage speed was high, although the variation of the iron loss value was small. When the sheet passage speed is high, the time from the heating of the steel strip to the electron beam irradiation becomes shorter, and the temperature of the steel sheet at the time of electron beam irradiation becomes higher than when the sheet passage speed is low, and hence the deterioration in the absolute value of iron loss is considered to be caused by a change in the steel sheet temperature during beam irradiation.

Therefore, we made a further investigation on the relationship between the deterioration in iron loss property and the steel sheet temperature during electron beam irradiation. Since it is difficult for heat transfer (heat release) under reduced pressure, investigation was conducted with the temperature immediately before entering the reduced pressure area regarded as the temperature at the time of electron beam irradiation.

FIG. 6 illustrates the relationship between the steel sheet temperature and the iron loss immediately before entering the pressure reduced area (vacuum vessel). It can be seen from FIG. 6 that the iron loss tends to deteriorate when the steel sheet temperature immediately before entering the pressured reduced area is 50° C. or higher. That is, magnetic domain refinement by the electron beam is achieved by introducing thermal strain into the steel sheet. In this respect, when the temperature of the steel sheet as a whole is high, the temperature distribution difference generated by local heating by the electron beam becomes small. As a result, it is believed that the amount of thermal strain introduced into the steel sheet decreases and the iron loss deteriorates.

Based on the above experimental results, it was discovered that it is important to conduct electron beam irradiation under the following conditions in order to stabilize at a high level the iron loss properties of the material subjected to the electron beam irradiation.

After delivering the steel strip wound in a coil shape, the steel strip is heated to 50° C. or higher, and moisture is removed from the steel sheet as much as possible before the steel sheet reaching the reduced pressure area for electron beam irradiation such that the amount of moisture carried into the area is restricted and the vacuum degree is stabilized at a high level.

In order to maintain good iron loss properties, it is necessary to set the temperature of the steel sheet at the time of entering the pressure reduced area to lower than 50° C. such that the difference in temperature distribution inside the steel sheet at the time of introduction of the thermal strain is sufficiently large to allow a sufficient amount of strain to be introduced by the electron beam irradiation.

The present disclosure is based on the above discoveries and main features thereof are as follows.

(1) A method of producing a grain-oriented electrical steel sheet, the method comprising performing magnetic domain refining treatment by irradiating with an electron beam, in a pressure reduced area, a surface of a grain-oriented electrical steel sheet after subjection to final annealing, the method further comprising: before the irradiating with the electron beam, delivering the grain-oriented electrical steel sheet wound in a coil shape and heating the delivered grain-oriented electrical steel sheet to 50° C. or higher; and then cooling the grain-oriented electrical steel sheet such that the grain-oriented electrical steel sheet has a temperature of lower than 50° C. at the time of entering the pressure reduced area.

(2) The method of producing a grain-oriented electrical steel sheet according to (1) above, wherein before the magnetic domain refining treatment is performed, tension coating is applied to the grain-oriented electrical steel sheet after subjection to final annealing.

(3) A production line for grain-oriented electrical steel sheets comprising: a vacuum vessel through which a grain-oriented electrical steel sheet is passed, an electron gun installed toward the grain-oriented electrical steel sheet passing through the vacuum vessel; a first differential pressure chamber and a second differential pressure chamber respectively disposed on an entry side and an exit side of the grain-oriented electrical steel sheet in the vacuum vessel; and a heater disposed on an entry side of the grain-oriented electrical steel sheet in the first differential pressure chamber disposed on the entry side of the vacuum vessel.

Advantageous Effect

According to the present disclosure, it is possible to reduce variations in iron loss among materials subjected to magnetic domain refining by electron beam irradiation and stably obtain good iron loss properties.

DETAILED DESCRIPTION

Figure 1:
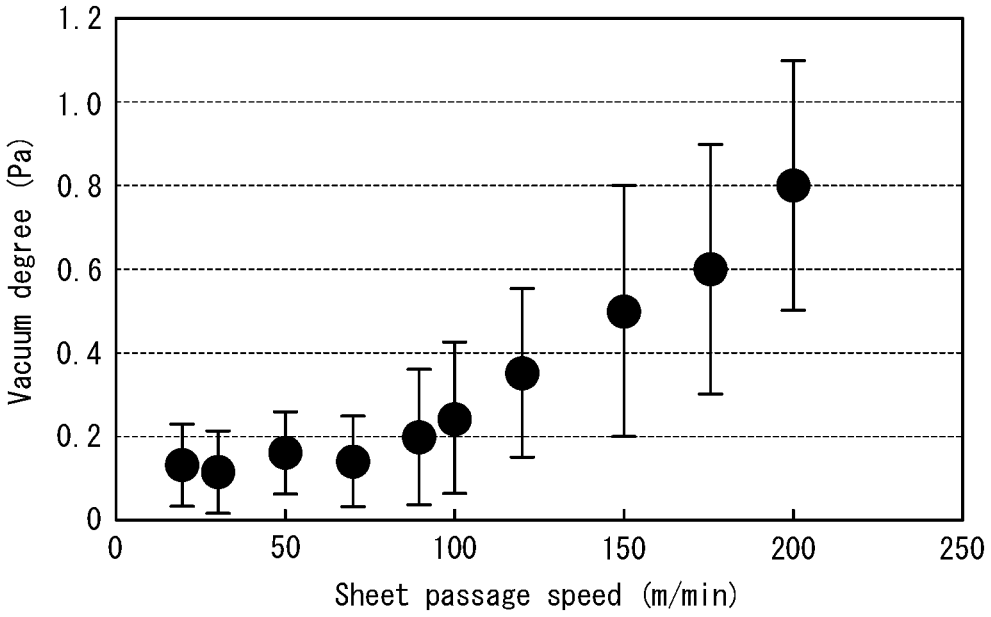
FIG. 1 is a graph illustrating the relationship between the sheet passage speed and the vacuum degree.
Figure 2:
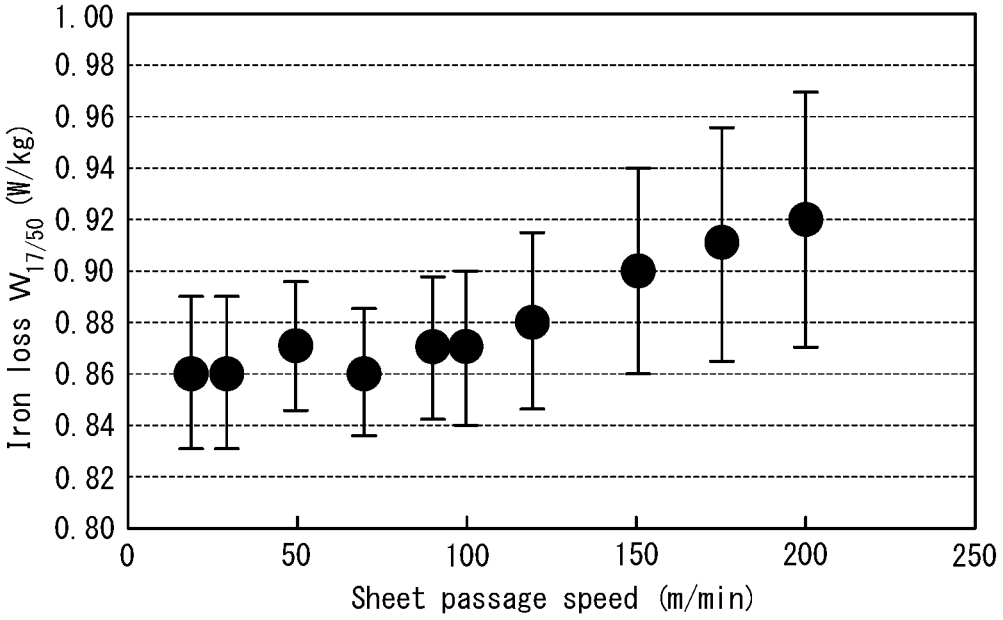
FIG. 2 is a graph illustrating the relationship between the sheet passage speed and the iron loss.
Figure 3A:
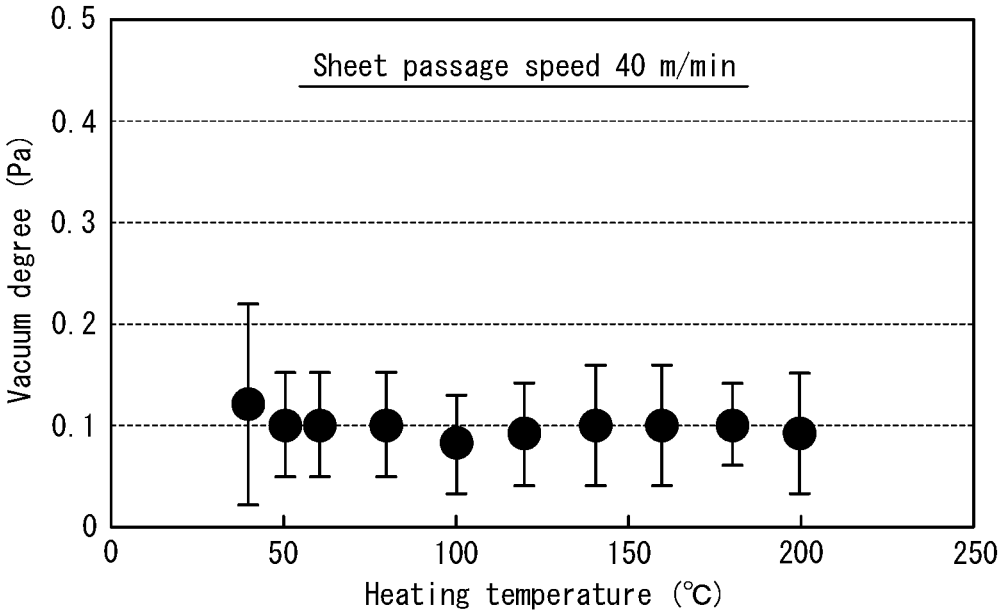
FIGS. 3A and 3B are graphs illustrating the relationship between the heating temperature and the vacuum degree.
Figure 3B:
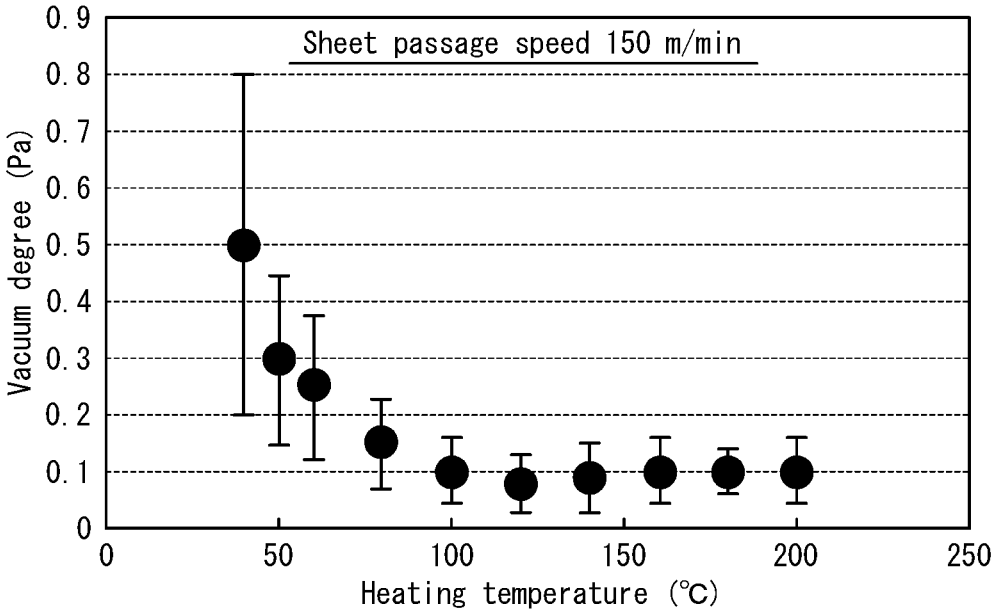
Figure 4:
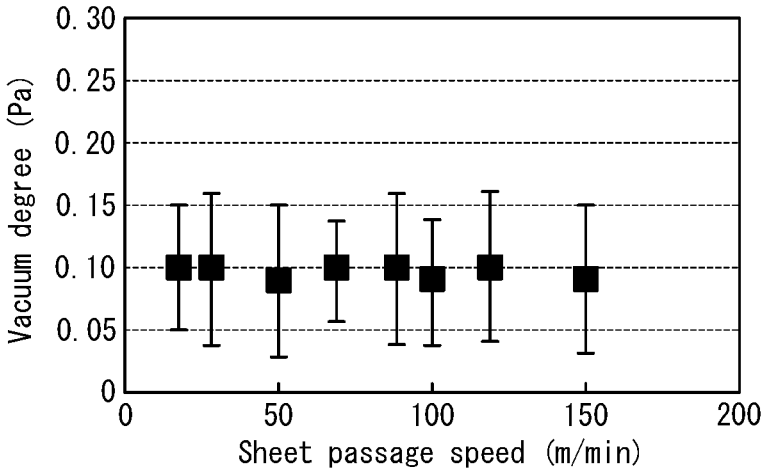
FIG. 4 is a graph illustrating the relationship between the sheet passage speed and the vacuum degree.
Figure 5:
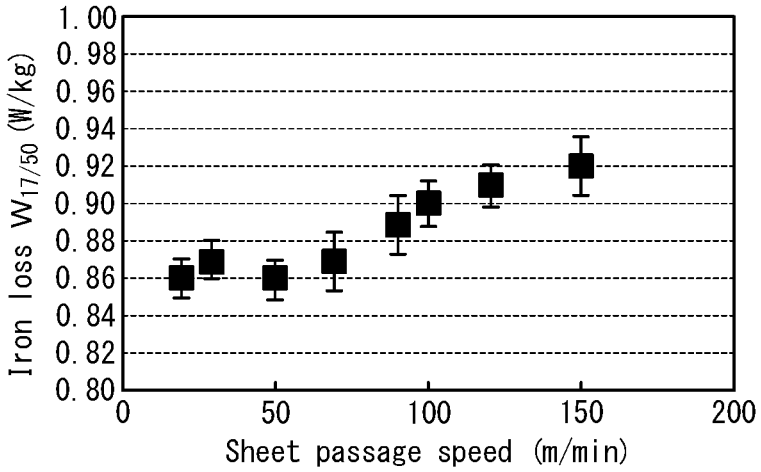
FIG. 5 is a graph illustrating the relationship between the sheet passage speed and the iron loss.
Figure 6:
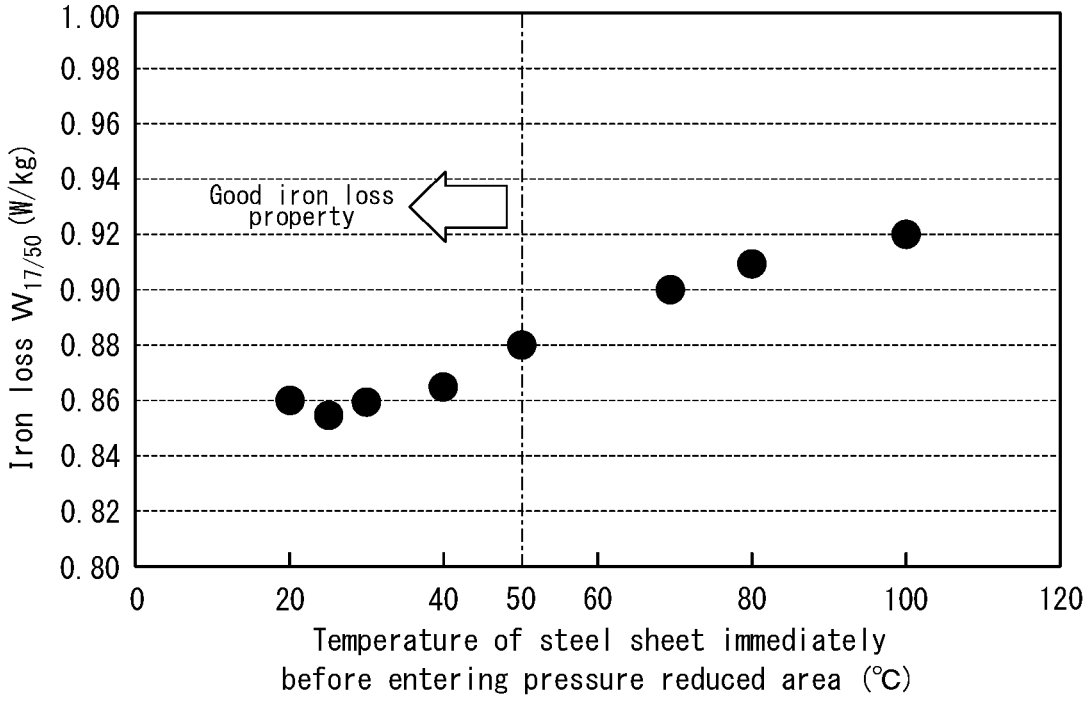
FIG. 6 is a graph illustrating the relationship between the steel sheet temperature and the iron loss immediately before entering a pressured reduced area.

A set of conditions for producing a grain-oriented electrical steel sheet according to the present disclosure will be described below.

In the present disclosure, the chemical composition of the slab for a grain-oriented electrical steel sheet is not particularly limited as long as it allows for secondary recrystallization.

In addition, in the case of using an inhibitor, e.g., an AlN-based inhibitor, Al and N may be contained in an appropriate amount, and in the case of using a MnS/MnSe-based inhibitor, Mn and Se and/or S may be contained in appropriate amounts, respectively. Of course, both inhibitors may also be used in combination. When such inhibitors are used, preferred contents of Al, N, S, and Se are Al: 0.01 mass % to 0.065 mass %; N: 0.005 mass % to 0.012 mass %; S: 0.005 mass % to 0.03 mass %; and Se: 0.005 mass % to 0.03 mass %. In final annealing, Al, N, S, and Se are purified and their contents are reduced to as low as the content of inevitable impurities.

The present disclosure is also applicable to a grain-oriented electrical steel sheet having limited contents of Al, N, S, and Se without using an inhibitor. In this case, it is preferable to reduce the contents of Al, N, S, and Se respectively to Al in an amount of less than 100 ppm by mass, N in an amount of less than 50 ppm by mass, S in an amount of less than 50 ppm by mass, and Se in an amount of less than 50 ppm by mass.

Specific examples of preferred basic components and other components to be optionally added of the slab for a grain-oriented electrical steel sheet of the present disclosure are as follows.

C: 0.08 Mass % or Less

C is added for improving the texture of a hot-rolled sheet. However, when the C content in steel exceeds 0.08 mass %, it is difficult to reduce the C content to 50 mass ppm or less where magnetic aging will not occur during manufacture. Thus, the C content is preferably set to 0.08 mass % or less. Note that no particular lower limit is necessarily placed on the C content because even a material not containing C allows for secondary recrystallization. It is also noted that C is reduced through decarburization annealing, and the C content will be as low as the content of inevitable impurities in the product sheet.

Si: 2.00 Mass % to 8.00 Mass %

Si is an effective element for increasing the electrical resistance of the steel and improving the iron loss properties. To obtain this effect, the Si content is preferably set to 2.00 mass % or more. On the other hand, when it exceeds 8.00 mass %, the workability remarkably deteriorates and the magnetic flux density also decreases. Therefore, the Si content is preferably set in the range of 2.00 mass % to 8.00 mass %.

Mn: 0.005 Mass % to 1.000 Mass %

Mn is an element necessary for improving the hot workability. To obtain this effect, the Mn content is preferably set to 0.005 mass % or more. On the other hand, when it exceeds 1.000 mass %, the magnetic flux density of the product sheet decreases. Therefore, the Mn content is preferably set in the range of 0.005 mass % to 1.0 mass %.

In addition to the above basic components, the following elements may be contained as appropriate, as elements for improving magnetic properties:

at least one selected from the group consisting of Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Ni is an element useful for improving the texture of the hot-rolled sheet and improving the magnetic properties, and is preferably contained in an amount of 0.03 mass % or more. On the other hand, if it exceeds 1.50 mass %, secondary recrystallization becomes unstable and the magnetic properties deteriorate. Therefore, the Ni content is preferably set in the range of 0.03 mass % to 1.50 mass %.

Sn, Sb, Cu, P, Cr, and Mo are useful elements for further improving the magnetic properties. The contents of these elements are preferably not lower than the respective lower limits described above. On the other hand, when their contents exceed the respective upper limits described above, the development of secondary recrystallized grains is inhibited. Therefore, if applicable, it is preferable to contain them in the respective ranges described above.

The balance other than the above-described components consists of Fe and inevitable impurities incorporated during manufacture.

Then, the slab having the above-mentioned chemical composition is heated in accordance with a conventional method before being subjected to hot rolling. At this time, after casting, the slab may be subjected directly to hot rolling without heating. In the case of a thin slab or thinner cast steel, the thin slab or thinner cast steel may be subjected either to hot rolling or directly to the subsequent steps by omitting hot rolling. If applicable, hot rolling is preferably performed such that the rolling temperature at the final pass of rough rolling is 900° C. or higher and the rolling temperature of the final pass of finish rolling is 700° C. or higher.

Further, hot band annealing is performed as necessary. At this time, in order to obtain a highly-developed Goss texture in the product steel sheet, a preferred hot band annealing temperature is in the range of 800° C. to 1100° C. Specifically, if the hot band annealing temperature is lower than 800° C., there remains a band texture resulting from hot rolling, which may make it difficult to obtain a primary recrystallized texture of uniformly-sized grains and inhibit the growth of secondary recrystallization. On the other hand, if the hot band annealing temperature exceeds 1100° C., the grain size after hot band annealing coarsens excessively, which may make it extremely difficult to obtain a primary recrystallization texture of uniformly-sized grains.

After the hot band annealing, the steel sheet is subjected to cold rolling once, or twice or more with intermediate annealing performed therebetween, followed by primary recrystallization annealing and application of an annealing separator. After the application of the annealing separator, the steel sheet is subjected to final annealing for purposes of secondary recrystallization and formation of a forsterite film. In this case, in the intermediate annealing, it is preferable that the annealing temperature is from 800° C. to 1150° C., and the annealing time is from about 10 seconds to about 100 seconds. In the primary recrystallization annealing, it is preferable that the annealing temperature is from 750° C. to 900° C., the degree of oxidation of atmosphere $PH_2O/PH_2$ is from 0.25 to 0.60, and the annealing time is from about 50 seconds to about 300 seconds. As the annealing separator, it is preferable that the main component is MgO, and the coating amount is from 8 g/m$^2$ to 15 g/m$^2$. In the final annealing, it is preferable to set the annealing temperature to 1100° C. or higher and the annealing time to 30 minutes or more.

After the final annealing, it is preferable to subject the steel sheet to flattening annealing to correct the shape. In the flattening annealing, it is preferable that the annealing temperature is from 750° C. to 950° C., and the annealing time is from about 10 seconds to about 200 seconds. In addition, before or after the flattening annealing, insulating coating is preferably applied to the surface of the steel sheet. As used herein, "insulating coating" refers to coating that may apply tension to the steel sheet to reduce iron loss (hereinafter, referred to as tension coating). The tension coating may be implemented by, for example, an inorganic coating containing silica or a ceramic coating applied by means of physical deposition, chemical deposition, and the like.

The most important thing in the present disclosure is that after the final annealing, the grain-oriented electrical steel sheet wound in a coil shape with an insulating coating applied thereon as necessary is delivered, or an insulating coating is applied to the surface of the delivered steel sheet, then the steel sheet is heated to 50° C. or higher, and subsequently moisture adhered to the steel sheet, which is a factor of the fluctuation of the vacuum degree, is removed before the steel sheet reaching the pressure reduced area for electron beam irradiation. When the heating temperature is lower than 50° C., it becomes difficult to efficiently remove the adhered moisture, and it is impossible to stabilize the vacuum degree by heating the steel sheet. In addition, from the viewpoint of efficient removal of adhered moisture, it is preferable that the time for holding the steel sheet at 50° C. or higher is 1.0 sec or more.

Then, the temperature of the steel sheet immediately before entering the pressure reduced area is set to lower than 50° C. This is because even when the temperature is 50° C. or higher, the dispersion of the iron loss is suppressed by the above-described vacuum degree stabilizing effect, but the iron loss deteriorates if the electron beam irradiation is performed at 50° C. or higher. The reason is that heating the steel sheet locally by electron beam irradiation generates a temperature distribution difference and introduces a thermal strain into the steel sheet, and such temperature distribution difference becomes small when the temperature of the steel sheet as a whole is 50° C. or higher, and the amount of strain to be introduced is reduced.

Figure 7:
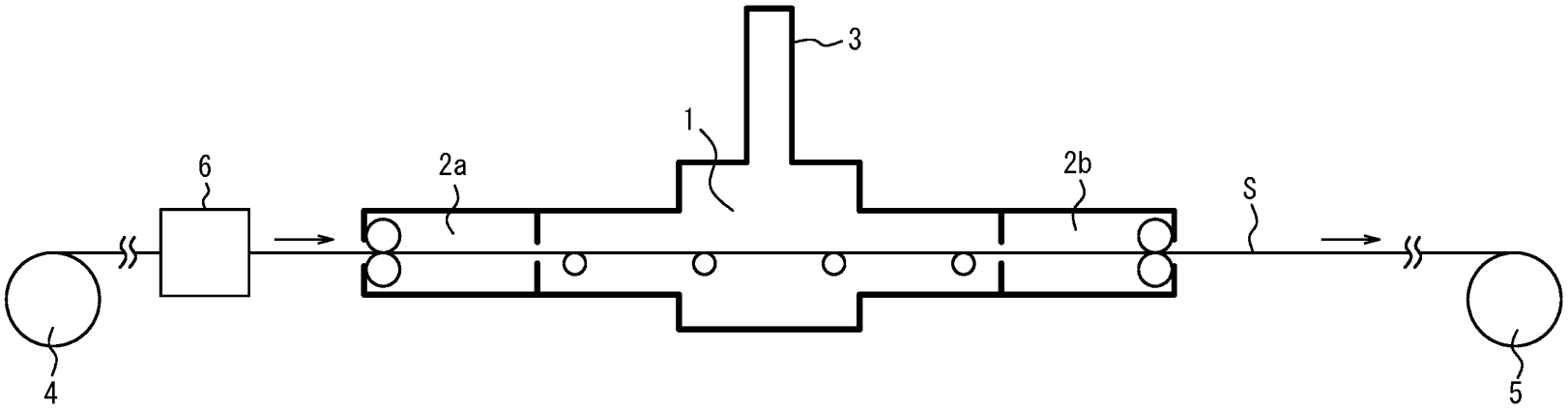
FIG. 7 illustrates a production line.

For example, a production line illustrated in FIG. 7 can be used for the process from the heating of the steel sheet after the final annealing to the electron beam irradiation. That is, in the production line illustrated in FIG. 7, the above-described pressure reduced area is provided in which differential pressure chambers 2*a* and 2*b* are respectively disposed on the entry side and the exit side of a steel strip S of a vacuum vessel 1. The vacuum vessel 1 is provided with an electron gun 3 configured to emit an electron beam toward the steel strip S passing through the vacuum vessel 1. The steel strip S after the final annealing is taken out from a pay-off reel 4 and wound around a tension reel 5 arranged on the exit side of the pressure reduced area, whereby the steel strip S is passed through the vacuum vessel 1. A heater 6 is installed between the pay-off reel 4 and the differential pressure chamber 2*a*, and the steel strip S is heated to 50° C. or higher by the heater 6. In the process of the heated steel strip S reaching the differential pressure chamber 2*a*, moisture adhered to the steel strip S, which is a factor of the fluctuation of the vacuum degree, is removed.

In this case, when the steel strip S is introduced into the differential pressure chamber 2*a*, in the process of the heated steel strip S reaching the differential pressure chamber 2*a*, it is necessary to adjust the distance between the differential pressure chamber 2*a* and the heater 6 and the sheet passage speed of the steel strip S such that the temperature of the steel sheet is lower than 50° C. as described above. It is also effective to positively cool the steel sheet by spraying gas thereon. In this case, although air may be blown, surface oxidation may occur when the temperature of the steel sheet is high. Thus, an inert gas such as Ar or $N_2$ is more preferable.

A heating means of the heater 6 is not particularly limited, and any conventionally known method may be used, such as induction heating, electric heating, resistance heating, or infrared heating. Also, the heating atmosphere is not particularly limited, and there is no problem if heating is carried out in the atmospheric atmosphere.

No upper limit is placed on the heating temperature of the steel sheet, yet a heating temperature of 200° C. or higher imposes severe limitations on the sheet passage speed and the place to perform heating in order to set the temperature of the steel sheet at the time of entry into the pressure reduced area to lower than 50° C. for the purpose of preventing deterioration in the iron loss properties. Therefore, a preferred upper limit is around 200° C.

A heating means for the steel sheet is not particularly limited, and any conventionally known method may be used, such as induction heating, electric heating, resistance heating, or infrared heating. Also, the heating atmosphere is not particularly limited, and there is no problem if heating is carried out in the atmospheric atmosphere.

In the present disclosure, after the heating of the steel sheet described above, magnetic domain refining treatment by electron beam irradiation is performed. As the electron beam irradiation conditions at this time, conventionally known conditions may be applied. The conditions include, for example, an accelerating voltage of 10 kV to 200 kV, a beam current of 0.1 mA to 100 mA, a beam scanning speed of 1 m/s to 200 m/s, an irradiation point interval of 0.01 mm to 1.0 mm in the direction perpendicular to the rolling direction, and an irradiation line interval of 1 mm to 20 mm in the rolling direction.

Examples

In each case, a slab having a chemical composition containing 0.07 mass % of C, 3.45 mass % of Si, 0.050 mass % of Mn, 0.10 mass % of Ni, 240 mass ppm of Al, 110 ppm by mass of N, 150 ppm by mass of Se, and 12 ppm by mass of S, with the balance consisting of Fe and inevitable impurities, was produced by continuous casting, heated to 1410° C., and hot rolled into a hot rolled sheet with a thickness of 2.5 mm, and the hot rolled sheet is subjected to hot band annealing at 1000° C. for 30 seconds. Then, the steel sheet was subjected to cold rolling to an intermediate sheet thickness of 2.0 mm, followed by intermediate annealing under a set of conditions including oxidation degree $PH_2O/PH_2$=0.39, temperature=1060° C., and time=100 seconds. Subsequently, after removing sub scales on the surface of the steel sheet by pickling with hydrochloric acid, cold rolling was carried out again to obtain a cold-rolled sheet having a thickness of 0.215 mm. Then, the steel sheet was subjected to decarburization whereby it was retained at an oxidation degree $PH_2O/PH_2$ of 0.47 and a soaking temperature of 840° C. for 200 seconds. Then, an annealing separator composed mainly of MgO was applied to the steel sheet, and final annealing aimed at secondary recrystallization, forsterite coating formation, and purification was carried out at 1220° C. for 100 hours. Then, an insulation coating composed of 60% colloidal silica and aluminum phosphate was applied to the steel sheet, and the resultant steel sheet was baked at 850° C. This coating application process also serves as flattening annealing. Subsequently, coils were subjected electron beam irradiation at different sheet passage timings under three different irradiation conditions. The sheet passage conditions in the electron beam irradiation process are as presented in Table 1, and each steel sheet was subjected to heating under various conditions before reaching the pressure reduced area. Table 1 also lists the average value and variation (standard deviation) of the vacuum degree, the average value and variation (standard deviation) of the iron loss, and the evaluation results of magnetic flux density.

Among Nos. 1 to 7 in which the irradiation conditions were the same, Nos. 3, 4, and 5 according to the present disclosure were manufactured under a high vacuum condition with less variation in vacuum degree, and thus exhibited smaller variations in iron loss and better results on the average iron loss level than Nos. 1 and 2 whose average iron loss level was outside the range of the present disclosure. Nos. 6 and 7 were manufactured under a high vacuum condition with less variation in vacuum degree, and thus exhibited small variations in iron loss, although they were outside the range of the present disclosure. However, the steel sheet temperature immediately before entering the pressure reduced area was high, which ended up raising the temperature of the steel sheet at the time of electron beam irradiation and deteriorating the average iron loss.

Next, among Nos. 8 to 13 in which the irradiation conditions were the same, Nos. 10, 11, and 12 according to the present disclosure were manufactured under a high vacuum condition with less variation in vacuum degree, and thus exhibited smaller variations in iron loss and better results than Nos. 8, 9, and 13 whose average iron level was outside the range of the present disclosure.

Furthermore, among Nos. 14 to 19 in which the irradiation conditions were the same, No. 16 according to the present disclosure was manufactured under a high vacuum condition with less variation in vacuum degree, and thus exhibited reduced variations in iron loss and better results than Nos. 14 and 15 whose average iron level was outside the range of the present disclosure. Nos. 17, 18, and 19 were manufactured under a high vacuum condition with less variation in vacuum degree, and thus exhibited small variations in iron loss, although they were outside the range of the present disclosure. However, the steel sheet temperature immediately before the pressure reduced area was high, which ended up raising the temperature of the steel sheet at the time of electron beam irradiation and deteriorating the average iron loss.

TABLE 1

| No. | Accelerating voltage (kV) | Scanning rate (m/sec) | Beam current (mA) | Line interval in RD direction (mm) | Holding point interval (mm) | Line speed (m/min) | Steel sheet heating temperature (° C.) | Temperature of steel sheet immediately before entering pressure reduced area (° C.) |
|---|---|---|---|---|---|---|---|---|
| 1 | 60 | 64 | 22 | 10 | 0.20 | 15 | no heating | 25 |
| 2 | 60 | 64 | 22 | 10 | 0.20 | 15 | 45 | 30 |
| 3 | 60 | 64 | 22 | 10 | 0.20 | 15 | 50 | 30 |
| 4 | 60 | 64 | 22 | 10 | 0.20 | 15 | 80 | 30 |
| 5 | 60 | 64 | 22 | 10 | 0.20 | 15 | 150 | 49 |
| 6 | 60 | 64 | 22 | 10 | 0.20 | 15 | 180 | 55 |
| 7 | 60 | 64 | 22 | 10 | 0.20 | 15 | 300 | 100 |
| 8 | 150 | 100 | 14 | 6 | 0.32 | 80 | no heating | 25 |
| 9 | 150 | 100 | 14 | 6 | 0.32 | 80 | 45 | 25 |
| 10 | 150 | 100 | 14 | 6 | 0.32 | 80 | 50 | 25 |
| 11 | 150 | 100 | 14 | 6 | 0.32 | 80 | 65 | 30 |
| 12 | 150 | 100 | 14 | 6 | 0.32 | 80 | 80 | 49 |
| 13 | 150 | 100 | 14 | 6 | 0.32 | 80 | 150 | 55 |
| 14 | 200 | 200 | 20 | 4 | 0.48 | 180 | no heating | 25 |
| 15 | 200 | 200 | 20 | 4 | 0.48 | 180 | 45 | 38 |
| 16 | 200 | 200 | 20 | 4 | 0.48 | 180 | 50 | 48 |
| 17 | 200 | 200 | 20 | 4 | 0.48 | 180 | 55 | 50 |
| 18 | 200 | 200 | 20 | 4 | 0.48 | 180 | 150 | 100 |
| 19 | 200 | 200 | 20 | 4 | 0.48 | 180 | 300 | 175 |

| No. | Average vacuum degree (Pa) | Variation in vacuum degree (standard deviation) | Average iron loss $W_{17/50}$ (W/kg) | Variation in iron loss (standard deviation) | Magnetic flux density $B_8$ (T) | Remarks |
|---|---|---|---|---|---|---|
| 1 | 0.13 | 0.11 | 0.79 | 0.024 | 1.93 | Comparative Example |
| 2 | 0.12 | 0.10 | 0.79 | 0.020 | 1.93 | Comparative Example |
| 3 | 0.10 | 0.05 | 0.76 | 0.010 | 1.93 | Example |
| 4 | 0.10 | 0.04 | 0.76 | 0.010 | 1.93 | Example |
| 5 | 0.10 | 0.04 | 0.76 | 0.010 | 1.93 | Example |
| 6 | 0.10 | 0.04 | 0.78 | 0.010 | 1.93 | Comparative Example |

TABLE 1-continued

| | | | | | | |
|---|---|---|---|---|---|---|
| 7 | 0.10 | 0.05 | 0.78 | 0.010 | 1.93 | Comparative Example |
| 8 | 0.22 | 0.18 | 0.73 | 0.031 | 1.93 | Comparative Example |
| 9 | 0.20 | 0.15 | 0.73 | 0.029 | 1.93 | Comparative Example |
| 10 | 0.12 | 0.07 | 0.71 | 0.015 | 1.93 | Example |
| 11 | 0.10 | 0.05 | 0.71 | 0.012 | 1.93 | Example |
| 12 | 0.10 | 0.05 | 0.71 | 0.012 | 1.93 | Example |
| 13 | 0.10 | 0.15 | 0.73 | 0.028 | 1.93 | Comparative Example |
| 14 | 0.80 | 0.28 | 0.75 | 0.027 | 1.93 | Comparative Example |
| 15 | 0.70 | 0.22 | 0.75 | 0.025 | 1.93 | Comparative Example |
| 16 | 0.30 | 0.06 | 0.72 | 0.013 | 1.93 | Example |
| 17 | 0.20 | 0.06 | 0.74 | 0.011 | 1.93 | Comparative Example |
| 18 | 0.20 | 0.05 | 0.75 | 0.010 | 1.93 | Comparative Example |
| 19 | 0.20 | 0.05 | 0.75 | 0.012 | 1.93 | Comparative Example |

REFERENCE SIGNS LIST

1 vacuum vessel
2*a*, 2*b* differential pressure chamber
3 electron gun
4 pay-off reel
5 tension reel
6 heater

The invention claimed is:

1. A method of producing a grain-oriented electrical steel sheet, comprising:

after final annealing, delivering the grain-oriented electrical steel sheet wound in a coil shape into a production line having a pressure reduced area;

then in the production line, heating the delivered grain-oriented electrical steel sheet to 50° C. or higher and 150° C. or lower, followed by cooling the grain-oriented electrical steel sheet such that the grain-oriented electrical steel sheet has a temperature of lower than 50° C. at the time of entering the pressure reduced area; and then irradiating a surface of the grain-oriented electrical steel sheet with an electron beam in the pressure reduced area of the production line.

2. The method of producing a grain-oriented electrical steel sheet according to claim 1, wherein the grain-oriented electrical steel sheet wound in a coil shape has tension coating applied thereon.

3. The method of producing a grain-oriented electrical steel sheet according to claim 1, wherein during the heating and cooling step, the delivered grain-oriented electrical steel sheet is heated to 50° C. or higher and 150° C. or lower, and then cooled such that the grain-oriented electrical steel sheet has a temperature of 20° C. or higher and lower than 50° C. at the time of entering the pressure reduced area.

4. The method of producing a grain-oriented electrical steel sheet according to claim 3, wherein the grain-oriented electrical steel sheet wound in a coil shape has tension coating applied thereon.

5. The method of producing a grain-oriented electrical steel sheet according to claim 1, comprising flattening annealing and applying insulating coating, wherein the grain-oriented electrical steel sheet wound in a coil shape is delivered into a production line having a pressure reduced area, and after final annealing, flattening annealing and applying insulating coating.

6. The method of producing a grain-oriented electrical steel sheet according to claim 5, wherein the insulating coating is applied to the surface of the steel sheet before the flattening annealing.

* * * * *